United States Patent [19]

Henricksen et al.

[11] 4,187,926

[45] Feb. 12, 1980

[54] LOUDSPEAKER HORN

[75] Inventors: Clifford A. Henricksen, Yorba Linda; Mark S. Ureda, Woodland Hills, both of Calif.

[73] Assignee: Altec Corporation, Anaheim, Calif.

[21] Appl. No.: 967,739

[22] Filed: Dec. 8, 1978

Related U.S. Application Data

[63] Continuation-in-part of Ser. No. 810,642, Jun. 27, 1977, abandoned.

[51] Int. Cl.[2] ..... G10K 11/00

[52] U.S. Cl. ..... 181/192; 181/187; 181/190

[58] Field of Search ..... 181/192, 177, 159, 180, 181/187, 188, 189, 190, 195

[56] References Cited

U.S. PATENT DOCUMENTS

| | | | |
|---|---|---|---|
| 1,365,249 | 1/1921 | Koehler | 181/192 |
| 1,526,819 | 2/1925 | Amoroso | 181/180 |
| 2,071,153 | 2/1937 | Abrahams | 181/180 |
| 2,537,141 | 1/1951 | Klipsch | 181/188 |
| 2 ,690,231 | 9/1954 | Levy et al. | 181/192 |
| 4,071,112 | 1/1978 | Keele, Jr. | 181/159 |

*Primary Examiner*—Stephen J. Tomsky
*Attorney, Agent, or Firm*—Edward A. Sokolski

[57] ABSTRACT

A loudspeaker horn has a throat section with a rectangular cross section to which the driver unit is coupled. The throat section has substantially parallel side walls joined together by diverging top and bottom walls. The horn has a rectangular mouth which is formed by a bell section which runs between the throat section and the mouth with an angular divergence corresponding to the desired horn dispersion pattern. If the mouth is made square, equal horizontal and vertical low frequency directivity roll off can be provided. On the other hand, with the speaker of the present invention, various relative horizontal and vertical directivity control can be obtained with different aspect ratios for the mouth. The walls of the bell section may be additionally flared outwardly at a portion thereof near the mouth to provide improved midrange directivity control. The use of planar sides between the throat section and the mouth also makes for an improved directivity pattern.

6 Claims, 5 Drawing Figures

LOUDSPEAKER HORN

This application is a continuation-in-part of our Application Ser. No. 810,642, filed June 27, 1977, now abandoned.

This invention relates to loudspeaker horns, and more particularly to such a horn utilizing outwardly flaring walls forming a bell section which runs between a rectangular cross-sectioned throat section and a rectangular mouth.

In the design of horn type loudspeakers, which are generally employed to provide acoustical output in the frequency range of 400–16,000 hertz, it is difficult to maintain control of the acoustical output to a desired dispersion pattern throughout the frequency range of interest. Control is particularly difficult in the low frequency portion of this range where in even the best prior art horn loudspeakers, control of the vertical desired coverage angle and the dispersion pattern of the acoustical energy departs considerably from the optimum desired pattern. Many of the prior art loudspeakers employ exponentially curved walls. Others, such as that described in U.S. Pat. No. 2,537,141, employ an arcuate mouth and multiple cell elements. Neither of these types of prior art horns is capable of achieving the low frequency control of the present invention.

In U.S. Pat. No. 4,071,112, a horn is described which has a first section having a pair of side walls which curve outwardly and which has a cross-sectional area which increases as an exponential function of the distance from the throat, a second section having a cross-sectional area which increases as the square of the distance from the interface with the first section and this expands conically, and a third section which has top and bottom planar walls and curved side walls and a cross-sectional area which increases as the square of the distance from its interface with the second section and thus also expands conically. This differs from the speaker of the present invention in which the side walls of the first section are substantially parallel and do not diverge from each other and in which there are no exponentially or conically expanding sections. It has been found that the speaker of the present invention has significantly improved directivity control over the speaker of U.S. Pat. No. 4,071,112, as shown in FIGS. 4 and 5 of the present application, these figures showing by the graph lines labelled "37" and "41" the acoustical dispersion pattern of a speaker of the type described in said patent and by the graph lines labelled "32" and "40" the acoustical dispersion pattern of the speaker of the present invention.

By employing a square mouth, it is possible to achieve equal horizontal and vertical directivity roll off in the low frequency range of the horn. The use of planar sides for the bell section of the horn minimizes "waistbanding" effect (i.e., spillover of radiation or sidelobing). The use of a bell section adjacent to the mouth of the horn which diverges at a greater angle than the main bell section minimizes beaming in the midfrequency range of the particular horn.

It is therefore the principal object of this invention to provide a loudspeaker horn having improved directivity control.

Other objects of the invention will become apparent as the description proceeds in connection with the accompanying drawings, of which:

Figure 1:
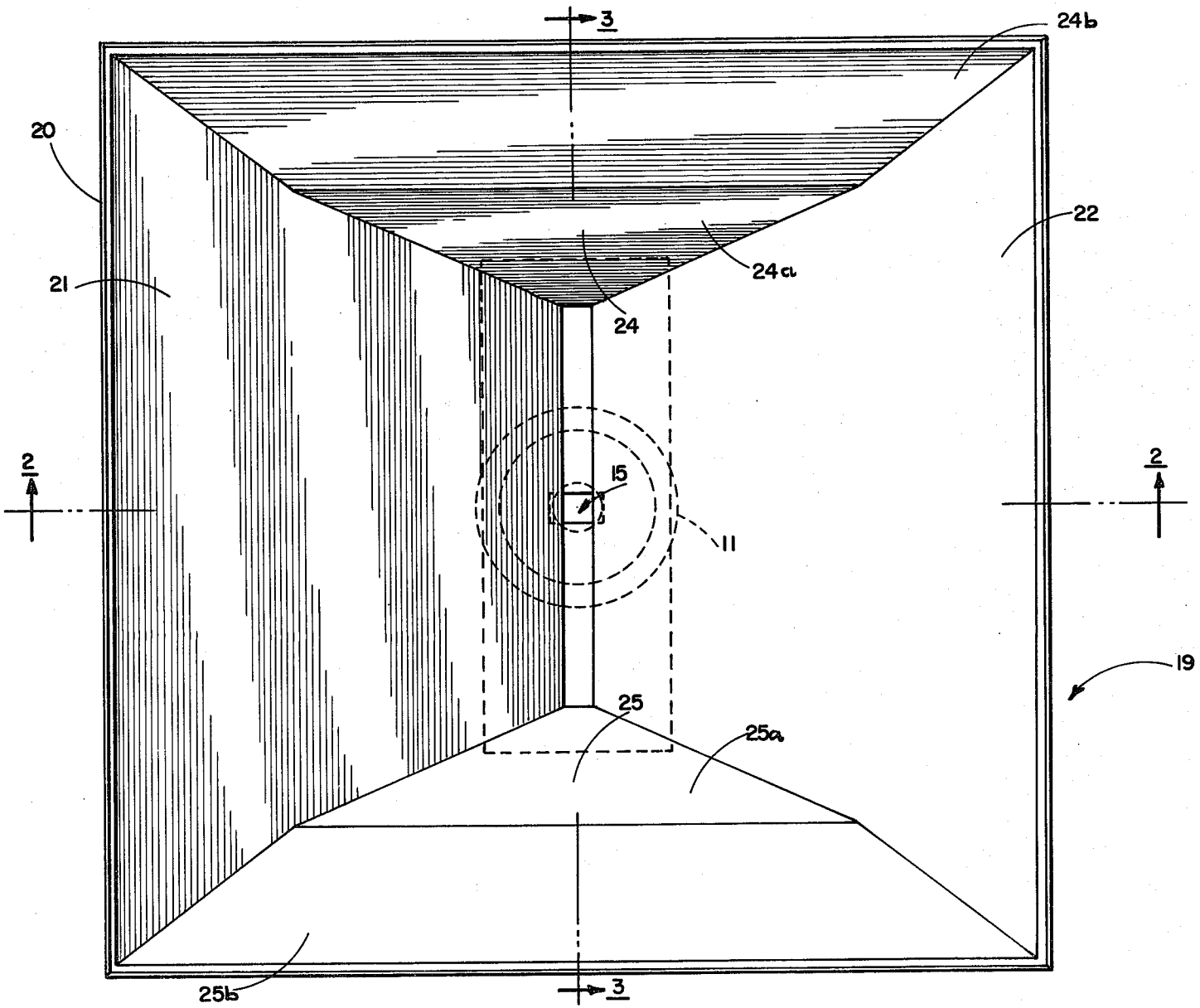
FIG. 1 is a front elevational view of a preferred embodiment of the invention.
Figure 2:
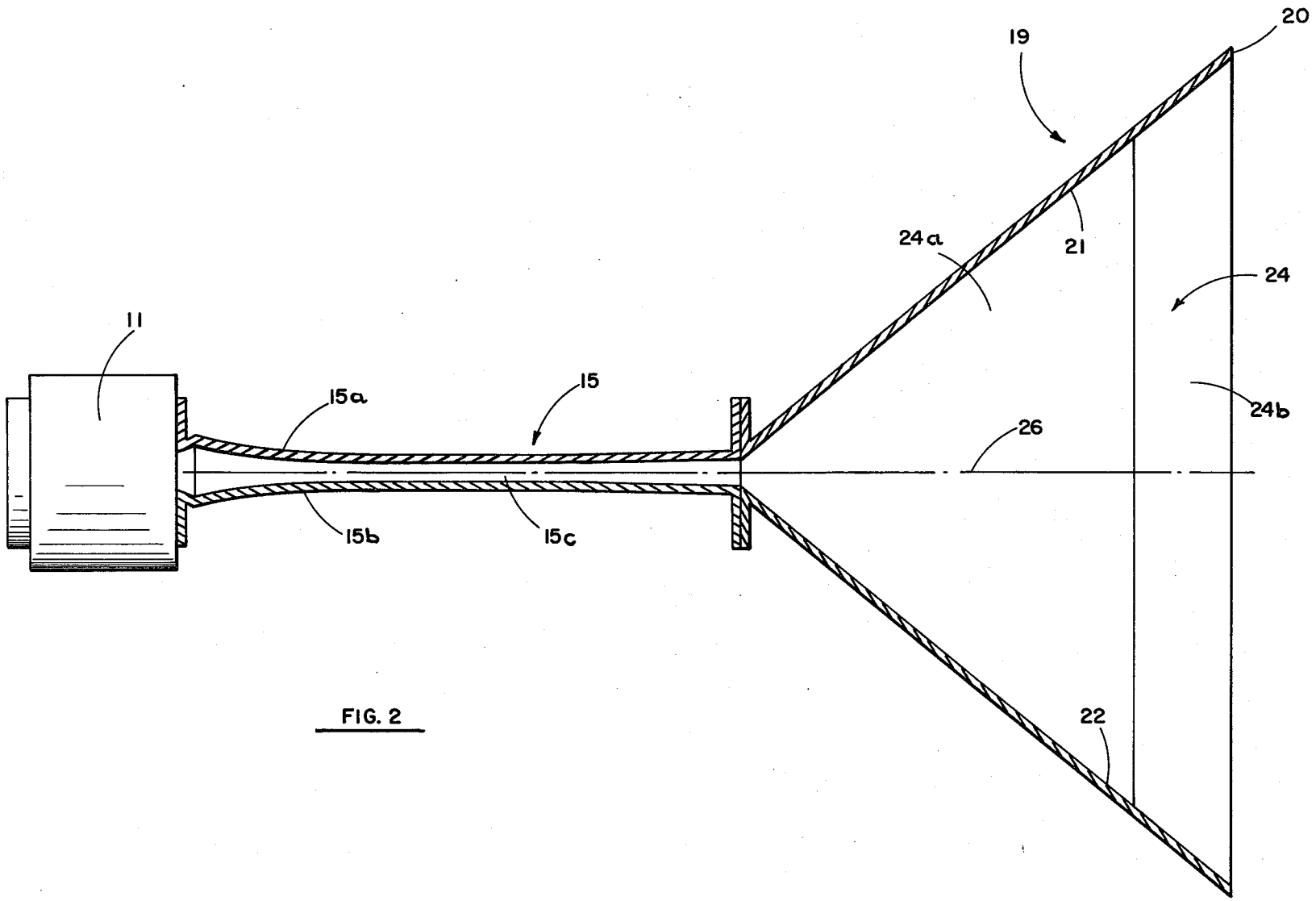
FIG. 2 is a cross-sectional view taken along the plane indicated by 2—2 in FIG. 1.
Figure 3:
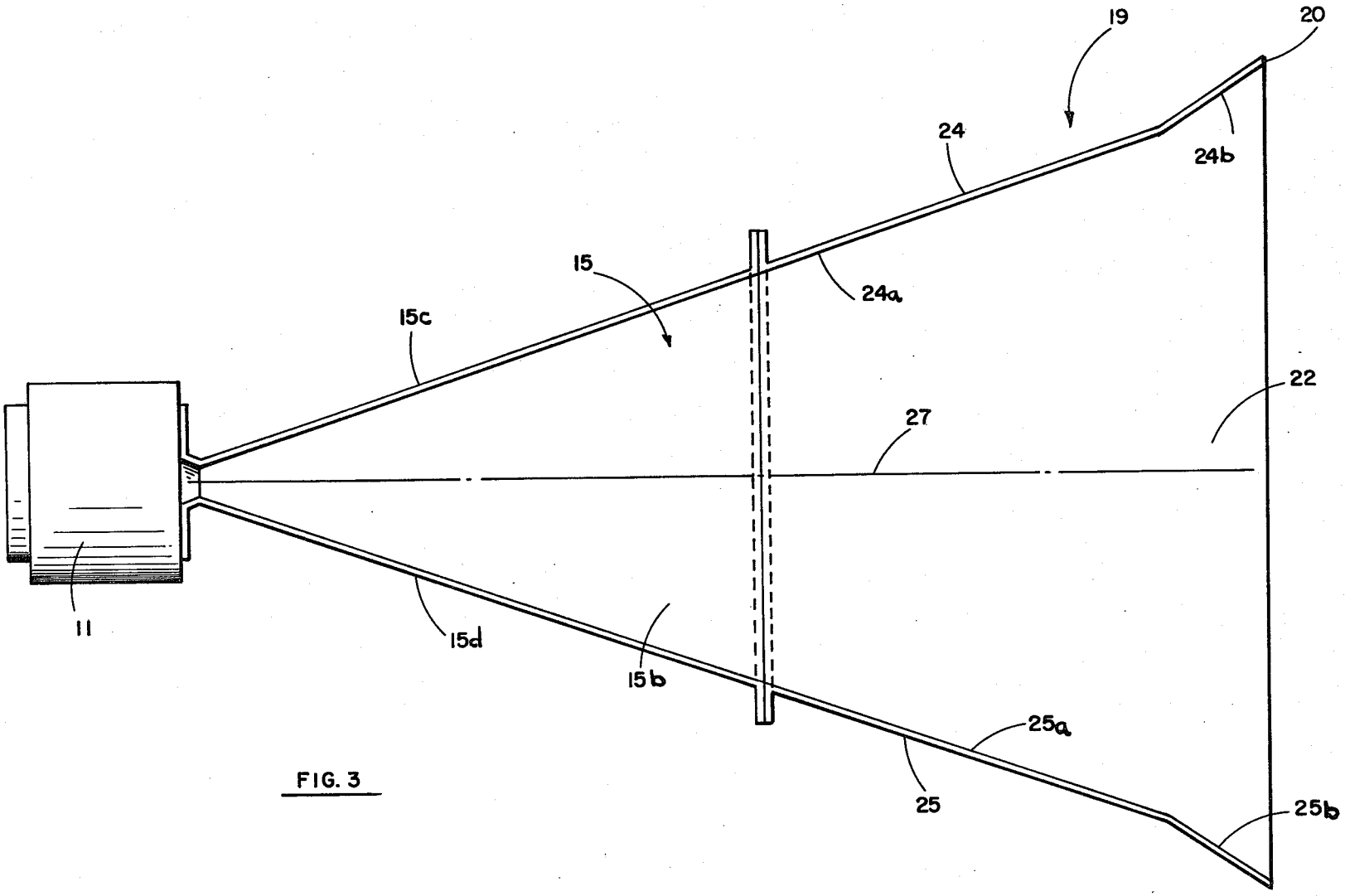
FIG. 3 is a cross-sectional view taken along the plane indicated by 3—3 in FIG. 1.

Briefly described, the device of our invention is as follows: The throat section of a loudspeaker horn is rectangular in cross section with acoustical energy being coupled thereto from a driver unit. The throat section has an expanding cross-sectional area and side walls which are substantially parallel, the side walls being joined together by top and bottom walls which diverge outwardly from each other. The mouth of the horn has a rectangular configuration, which in the illustrative embodiment is square, and is formed by a bell section having walls which diverge outwardly from the throat section, there being a first pair of diverging top and bottom walls, and a second pair of diverging side walls which join with the top and bottom walls along the edges thereof to form an integral unit. The walls of the bell section may be flared outwardly an additional amount at a portion thereof immediately adjacent to the mouth to provide improved control in the midfrequency range of the speaker. The divergenceangle between the top and bottom walls and that between the side walls generally determines the dispersion angle of the acoustical energy. In the preferred embodiment, the divergence angle between the side walls of the bell section is substantially greater than that between the top and bottom walls of this section and these top and bottom walls form continuums of the top and bottom walls of the throat section. A significant feature of the present invention is that the horizontal and vertical angles and the dimensions across the mouth (which determine the directivity control bandwidths) can be varied independently and in so doing the characteristic throat section of the horn can be generated.

Referring now to the figures, the acoustical output of audio driver unit 11 is coupled to throat section 15. Throat section 15 has a pair of opposite walls **15*a* and 15*b* which are substantially parallel to each other through most of their lengths, and which are joined together by diverging top and bottom planar walls 15*c* and 15*d*. The mouth 20 of the horn is rectangular (square in the illustratative embodiment) in shape and is formed by a bell section 19 having a pair of diverging planar side walls 21 and 22 which flare outwardly from throat section 15, and a pair of diverging planar top and bottom walls 24 and 25 which also flare outwardly from throat section 15 and are joined along their edges to the edges of walls 21 and 22. Walls 24 and 25 have first portions 24*a* and 25*a* which diverge outwardly at a first lesser angle, and second portions 24*b* and 25*b* which diverge outwardly at a second greater angle. Wall portions 24*a* and 25*a* are coplanar with walls 15c and 15d respectively, and thus are continuums thereof. The angle of divergence of wall portions 24*b* and 25*b* is generally made greater than that of wall portions 24*a* and 25*a* by a factor which is directly proportional to the desired angle of coverage of the speaker. It has been found that the additional divergence between wall portions 24*b* and 25*b* provides better control of the desired angle on this axis in the midrange of the frequencies of interest (1–5 kHz). If so desired, similar additionally diverging wall portions can be provided at the mouth ends of wall portions 21 and 22**.

The separation between walls 15*a* and 15*b* of the throat section at their juncture with bell section walls 21 and 22 should be no greater than the wavelength of sound at the highest frequency to be controlled. It is also important to note the divergence angle between walls 21 and 22 is substantially greater than that between walls 15*c* and 15*d*, and that the vertical mouth dimension may be made greater than in a normal horn designed for the same coverage angle. This enables better vertical directivity control at low frequencies of interest in a speaker of normal physical proportions.

Figure 4:
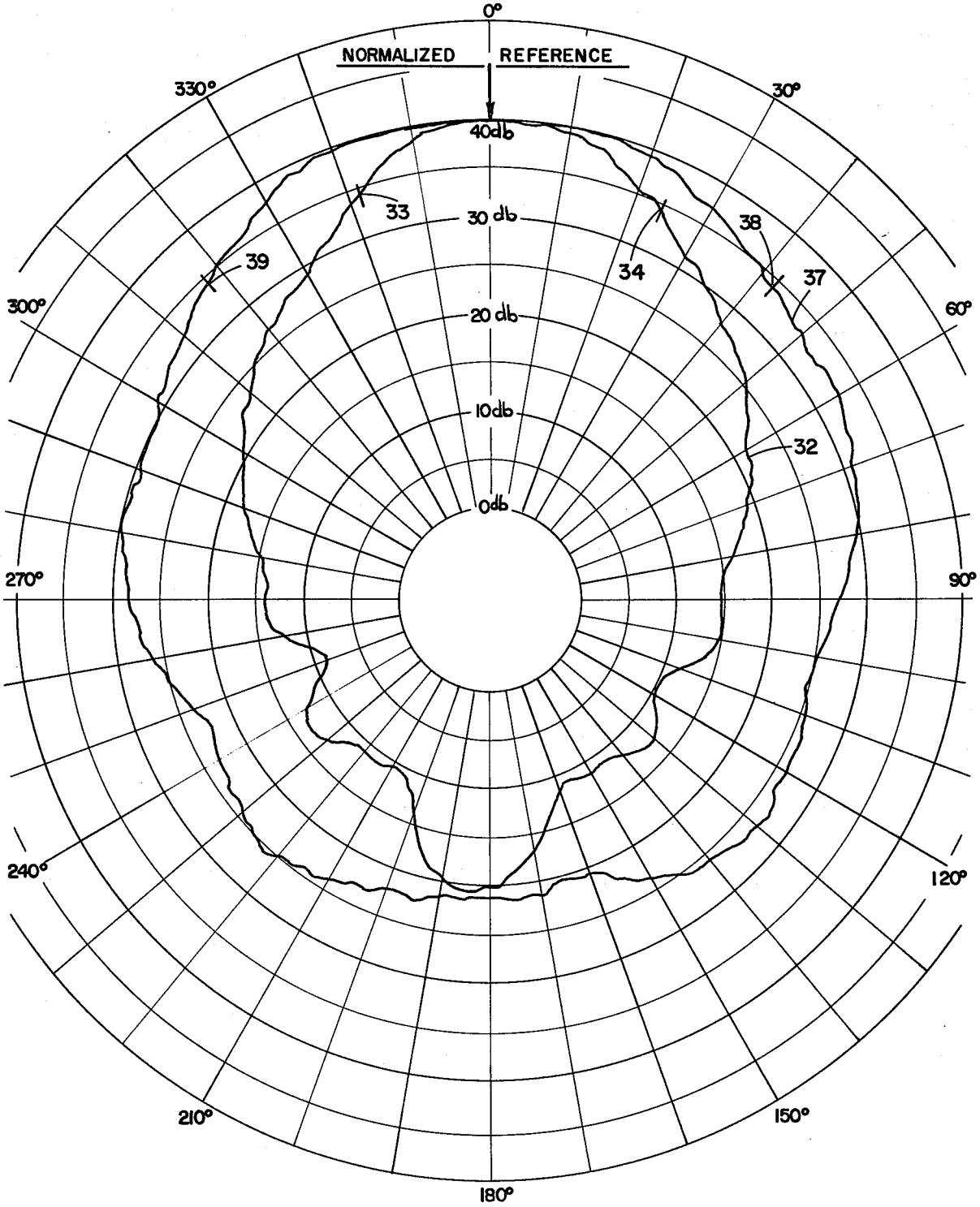
FIG. 4 and FIG. 5 are polar diagrams comparing sound radiation patterns of the device of the present invention with that of a prior art loudspeaker horn.
Figure 5:
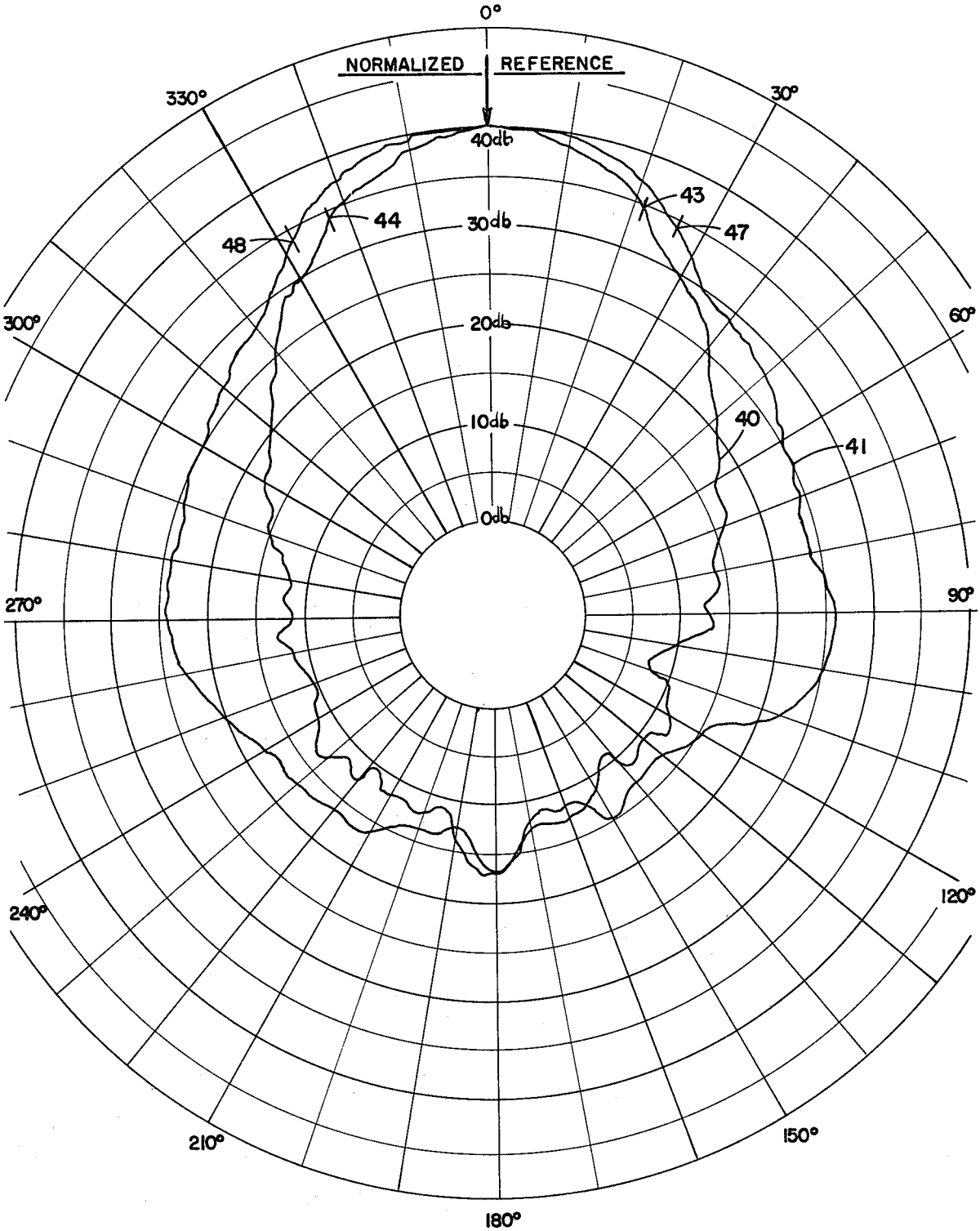

Referring now to FIGS. 4 and 5, polar graphs showing the sound radiation patterns of the speaker of the present invention as compared with a typical prior art speaker (that described in U.S. Pat. No. 4,071,112) are shown. Referring to FIG. 4, graph line 32 shows the dispersion pattern of the acoustical energy at 800 Hz from a loudspeaker horn designed in accordance with the present invention. The optimum dispersion pattern designed for in this instance was one generally pie-shaped and having an angle of 45° (i.e., with the quarter power points separated from each other by 45°). As can be seen, the quarter power points 33 and 34 are separated from each other by 43°. Graph line 37 shows the acoustical dispersion pattern at 800 Hz of a prior art horn having the best directivity control characteristics heretofore known. As in the first instance, the design attempt was for a 40° dispersion. As can be seen, the acoustical output of this prior art horn has its quarter power points 38 and 39 separated by 84° and has a dispersion pattern which is a considerably greater departure from the optimum than that of the present invention.

Referring now to FIG. 5, the acoustical dispersion patterns of the speaker of the present invention and that of the same prior art speaker as for FIG. 4 are illustrated for 2500 Hz (the midrange of the speaker outputs). Graph line 40 shows the pattern for the speaker of the present invention, while graph line 41 shows that of the prior art speaker. As can be seen, the quarter power points 43 and 44 of the instant speaker are 40° apart as compared with 58° for the quarter power points 47 and 48 of the prior art speaker. There is also a considerable difference between the two directivity patterns, indicating a substantial improvement in directivity control in the midfrequency range for the speaker of the present invention, more acoustic power being delivered at the desired coverage angle.

The device of the present invention thus provides a substantial improvement over the prior art in its directivity control characteristics in the low and mid-frequency ranges of the horn.

While the device of this invention is described and illustrated in detail, it is to be clearly understood that this is intended by way of illustration and example only and is not to be taken by way of limitation, the spirit and scope of this invention being limited only by the terms of the following claims.

We claim:

1. A loudspeaker horn for receiving and radiating acoustical energy with directivity control from an acoustical driver comprising:

a throat section connected to said driver having a rectangular transverse cross section and including a first pair of walls which are substantially parallel to each other, and a second pair of walls which diverge outwardly from each other from said driver at a predetermined angle, the acoustical energy output of the driver being coupled to said throat section, a rectangular mouth portion having a substantially greater perimeter than that of the greatest transverse cross section of said throat section, a first pair of bell section walls which interconnect the first pair of walls of the throat section and the mouth portion, and which diverge outwardly for the entire distance between said throat section and said mouth portion, and a second pair of bell section walls which interconnect the second pair of walls of the throat section and the mouth portion and which diverge outwardly between the throat section and a point proximate to the mouth portion at the same angle as the second pair of throat section walls, the portions of said second pair of interconnecting walls connected to the second pair of throat section walls forming a continuum thereof, said first and second pairs of interconnecting walls being joined together along the edges thereof to form a flared bell section of said horn, said first pair of walls of said bell section diverging outwardly at a substantially greater angle than said second pair of bell section walls.

2. The loudspeaker horn of claim 1 wherein at least one of said pairs of walls of the bell section includes two portions, one of which is closer to said throat section and is flared at a first angle and a second one of which is closer to said mouth portion and is flared at a second angle greater than said first angle.

3. The loudspeaker horn of claim 1 wherein the first pair of walls of the throat section form the side walls thereof and the second pair of walls of the throat section are substantially planar and form top and bottom wall portions which diverge outwardly from each other between the driver and the bell section, said side wall portions joining said top and bottom wall portions together to form an integral unit.

4. The loudspeaker horn of claim 1 wherein the bell section walls are planar.

5. The loudspeaker horn of claim 1 wherein the separation between the first pair of walls of the throat section at their interconnection with the bell section is no greater than the wavelength of sound at the highest frequency of the sound waves to be controlled.

6. The loudspeaker horn of claim 1 wherein the mouth portion is square.

* * * * *